US005288217A

United States Patent [19]

Contiero

[11] Patent Number: 5,288,217

[45] Date of Patent: Feb. 22, 1994

[54] CYCLIC VOLUME MACHINE

[76] Inventor: Italo Contiero, via Lungargine 3, I-35010 Cadoneghe (PD), Italy

[21] Appl. No.: 820,193

[22] Filed: Jan. 13, 1992

Related U.S. Application Data

[63] Continuation-in-part of Ser. No. 578,039, Sep. 4, 1990, abandoned, and a continuation-in-part of Ser. No. 16,381, Dec. 30, 1986, abandoned.

[51] Int. Cl.[5] ..... F01C 1/22; F01C 1/344; F01C 21/08

[52] U.S. Cl. ..... 418/150; 418/270

[58] Field of Search ..... 418/54, 61.1, 150, 225, 418/253, 254, 255, 257, 270

[56] References Cited

U.S. PATENT DOCUMENTS

| | | | |
|---|---|---|---|
| 3,285,189 | 11/1966 | Doyer | 418/54 |
| 3,295,505 | 1/1967 | Jordan | 418/270 |
| 3,387,596 | 6/1968 | Niemand | 418/150 |
| 3,950,117 | 4/1976 | Artajo | 418/150 |

FOREIGN PATENT DOCUMENTS

| | | | |
|---|---|---|---|
| 997998 | 10/1976 | Canada | 418/270 |
| 1376285 | 9/1964 | France . | |
| 2493397 | 5/1982 | France . | |
| 789375 | 1/1958 | United Kingdom . | |
| 1521960 | 8/1978 | United Kingdom | 418/270 |

OTHER PUBLICATIONS

*Rotoidi,* Contier et al., Mar. 1985.

*Primary Examiner*—John J. Vrablik

*Attorney, Agent, or Firm*—Hoffman, Wasson & Gitler

[57] ABSTRACT

A rotating machine with variable volumes which can rotate in one and/or two directions like the transmission shaft, more of less than ($2\pi$). The machine is composed of a body with an inner cavity holding an articulated rotating prismatic structure, composed of one or more sides. Between the inner cavity and the sides of the prismatic structure, and among the same sides in the inner area, are fluid-retaining variable-volume chambers. The cyclic volume machine exploits the variations of the physical characteristics of fluids whose movements are the cause or effect of transmission shaft rotation. In transverse bars, and/or appropriate hinges between the sides of the rotor, centripetal forces oppose centrifugal forces. Lubricating and cooling systems are foreseen. The cyclic volume machine can be coaxial to a common transmission shaft and may be used as a pump, compressor, motor, engine, valve, distributor, hydraulic joint, and heat generator. It may also feed an electric magnet-hydrodynamic generator, and act as a compressor or booster for motors with inner reactive combustion.

6 Claims, 13 Drawing Sheets

CYCLIC VOLUME MACHINE

This is a continuation-in-part of copending U.S. application Ser. No. 578,039 filed on Sep. 4, 1990, now abandoned , which is a continuation-in-part of copending U.S. application Ser. No. 07/016,381, filed on Dec. 30, 1986, now abandoned.

This invention relates to a rotary machine which exploits inner cyclic variable volumes, and to an apparatus for transforming a known curve into a new curve by which to design the stator cavity of a cyclic volume machine.

Rotary machines which exploit inner cyclic variable volumes are well known. Generally they comprise a rigid or deformable rotor, which rotates inside a stator cavity. Volumes are defined between the stator and the rotor, the volumes vary when a relative motion occurs between stator and rotor. These cyclic volume variations are generally exploited to generate thermodynamic phenomena and to carry out transfers of fluids.

A rotary machine with defined volumes is reproducible when the stator cavity in contact with the rotor vertices is defined unequivocally, i.e. the curve of the rotor vertices is defined mathematically.

Examples of rotary machines are described in the following documents: US-A-716,970, US-A-3,295,505, US-A-418,148, US-A-3,918,415, US-A-3,950,117, FR-A-781,517, GB-A-1,521,960, DE-A1-2,321,763, FR-A-1,376,285, GB-A-789,375, and GB-A-b 26,118.

However in all machines disclosed in these documents, neither the trajectory of the rotor vertices nor the shape of the stator cavity is defined, and therefore these machines are not reproducible.

Rotary machines in which either the trajectory of the rotor vertices, or the shape of the stator cavity are mathematically defined are also well known. However, in these machines, which are disclosed, for example, in US-A-2,278,740, US-A-3,642,390, US-A-4,432,711 and FR-A-2,493,397, the trajectories of the rotor vertices are not defined by means of only one equation. The rotor vertices run along different arches of curves and the discontinuities of the rotor trajectories, in the connection points of the arches, causes vibrations, quick wear and tear, and loss of seal.

From the Wankel engine and CA-A-997,998 rotary machines are also known in which the trajectories of the rotor vertices, as well as the shape of the stator cavity, are defined by means of a single mathematical equation. Examples of such machines are the Wankel engine and CA-A-997,998. However, this equation is of transcendent type and the stator curve can be drawn only by an interpolation of points; consequently, according to these patents, the rotary machine can be realized only with great constructive complications and with unavoidable approximations.

One object of the present invention is to eliminate all the above-mentioned drawbacks and to construct a rotary machine in which the trajectory of the rotor vertices and the shape of the stator cavity can be defined by means of only one simple mathematical equation, easily drawn with continuity by means of simple hinged mechanisms.

Another object of the invention is to realize a rotary machine, with a rotor having any number of vertices.

A third object of the invention is to realize a cyclic volume machine, whose rotor can be either of rigid or of hinged type.

The cyclic volume machine according to the invention comprises:

one stator with one cylindrical cavity U of contour one transmission shaft with axis of rotation $Y_c$;

one rotor with axis of rotation $Y_o$ parallel to axis $Y_c$ and with Nr sides which have $N_e$ equal cylindrical surfaces E of radius r at their ends; stator cavity U has a perimetral surface of contour M which is the external envelope of $N_e$ cylindrical surfaces E of $N_r$ rotor sides; surface E of each rotor side has longitudinal axes $Y_1(I=1, 2 \ldots N_e)$ parallel to axis $Y_c$ and orthogonally intersecting a plane Γ in points P, $P_{1+1}$ at an equal distance $\overline{W}$ for any angular position of the rotor, wherein, referring to a polar system of coordinates with pole C and polar axis X on a reference plane Γ; the pole C is the point of intersection between axis $Y_c$ and plane Γ.

Each rotor side is a rotating and/or translating piston with vertices $O_1$ and $O_{i+1}$ running along a curve belonging to a new family of curves $R^n$ which have the property of invariant length $\overline{W}=\overline{P_iP_{i+1}}$. The inventor has named curves $R^N$ ROTOIDS. Rotoids are defined by an equation obtained by transforming a given equation which defines a simple plane and closed curve L. The law (1) of transformation is : $g_{(\partial)}=\overline{W}\cdot f_{(\alpha)}/W_{(\alpha)}$ $0<\alpha<2\pi$ wherein:

$g_{(\partial)}$ is a non-constant function defining a curve $R^N$ in polar coordinates, $g_{(\partial)}=\overline{CP_1}$ is the radius of one rotor vertex, $\partial=P_1\hat{C}X$ is the angular abscissa of radius g, $f_{(\alpha)}$ is a given continuous positive function defining the polar radius f curve L, $\alpha=F_1\hat{C}X$ is the angular abscissa of radius f $0<\alpha<2\pi F_{(\alpha)}=/\overline{CF_1}$, $\overline{W}$ is the length of segment $\overline{P_iP_{i+1}}$ of each piston, i=i to N, N is an integer to which the modulus of a rotoid curve $R^N$ corresponds, $W_{(\alpha)}$ is side length of an equilateral N-polygon The machine according to the invention may rotate in one or two directions, like the transmission shaft. The transmission shaft may rotate more or less than angle $2\pi$: when it is more than $2\pi$, this machine is of rotating cyclic volume type; when rotation is less than $2\pi$, it is of cyclic volume reciprocating type.

The inner stator surface M of this new machine is an envelope of a cylinder with axis $Y_i$ perpendicular to plane Γ in a rotoid $R^N$. The most important rotoid curves may be machine-tooled and drawn with continuity by means of continuous lines.

A curve L defined by interpolation of points may also be transformed by law (Equation 1) into a rotoid curve.

The cyclic volume machine may be made in many shapes and used for many purposes: it can work as a pump, compressor, motor, engine, valve, distributor, or hydraulic joint; it may burn fuel for heat and/or electricity as in magneto-hydrodynamic generators; it can also be used as a compressor and/or booster for thermic motors with inner reactive combustion.

The present invention also relates to an apparatus for drawing with continuity rotoid curves of modulus N according to Equation (1) as set forth on Page 3, lines 3–22 wherein a frame of vertical axis $Y_c$ supports;

a first table rotating around axis $Y_c$, with two rectilinear runners for slides of axes f and which are reciprocally orthogonal in pole C, and parallel to a reference plane Γ, a generic plane runner L fixed on the base of the frame parallelly to plane Γ, and a second rotating table coaxial and parallel over the first rotating table.

An hinged mechanism, placed between frame base and a first rotating table, comprising a plurality of hinged bars and pins orthogonal to plane Γ and moving along both the runner L and the table runners f and g, moves a marker of axis $Y_p$, orthogonal to plane F, actuated by the hinged mechanism, and draws a curve of radius $\overline{Y_pY_c}$ on a drawing plane parallel to plane Γ.

The drawing plane is fixed to the second rotating table.

Some embodiments of this invention are now described by means of examples with reference to the accompanying drawings in which.

In all the figures capital letters M and E indicate the contours of cross-sections of respective cylindrical surfaces M and E.

Figure 1:
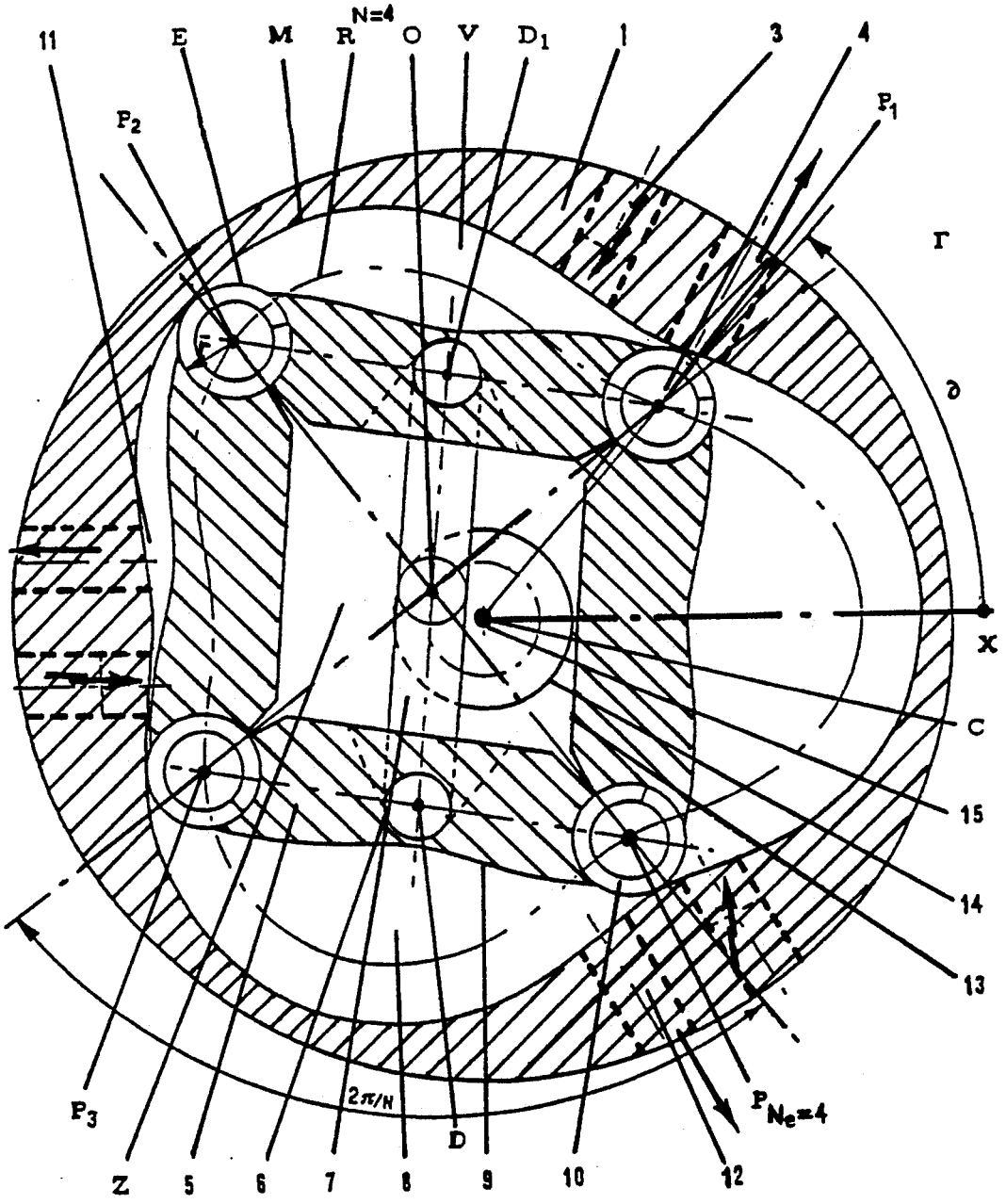
FIG. 1 shows a generic type of machine in which axes $Y_o$, $Y_c$ are distinct and parallel. The machine has a four-sided rotor ($N=4$ $N=N_3=N_r$)..
Figure 2:
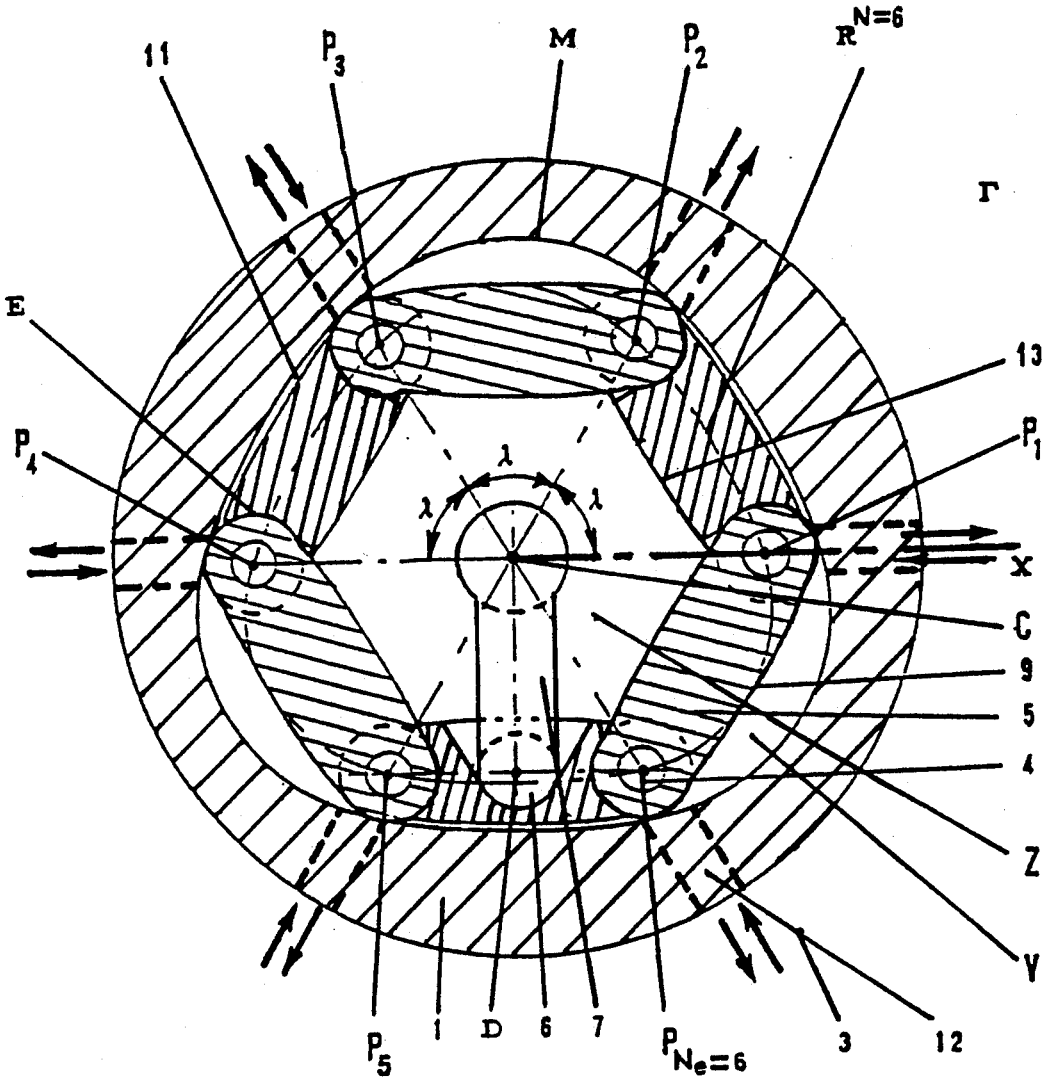
FIG. 2 shows a machine with a six-sided rotor ($N=6$; $1\ N=N_e=N_r$) and an inner stator contour M with three lobes; axes $Y_o$, $Y_c$ coincide.
Figure 3:
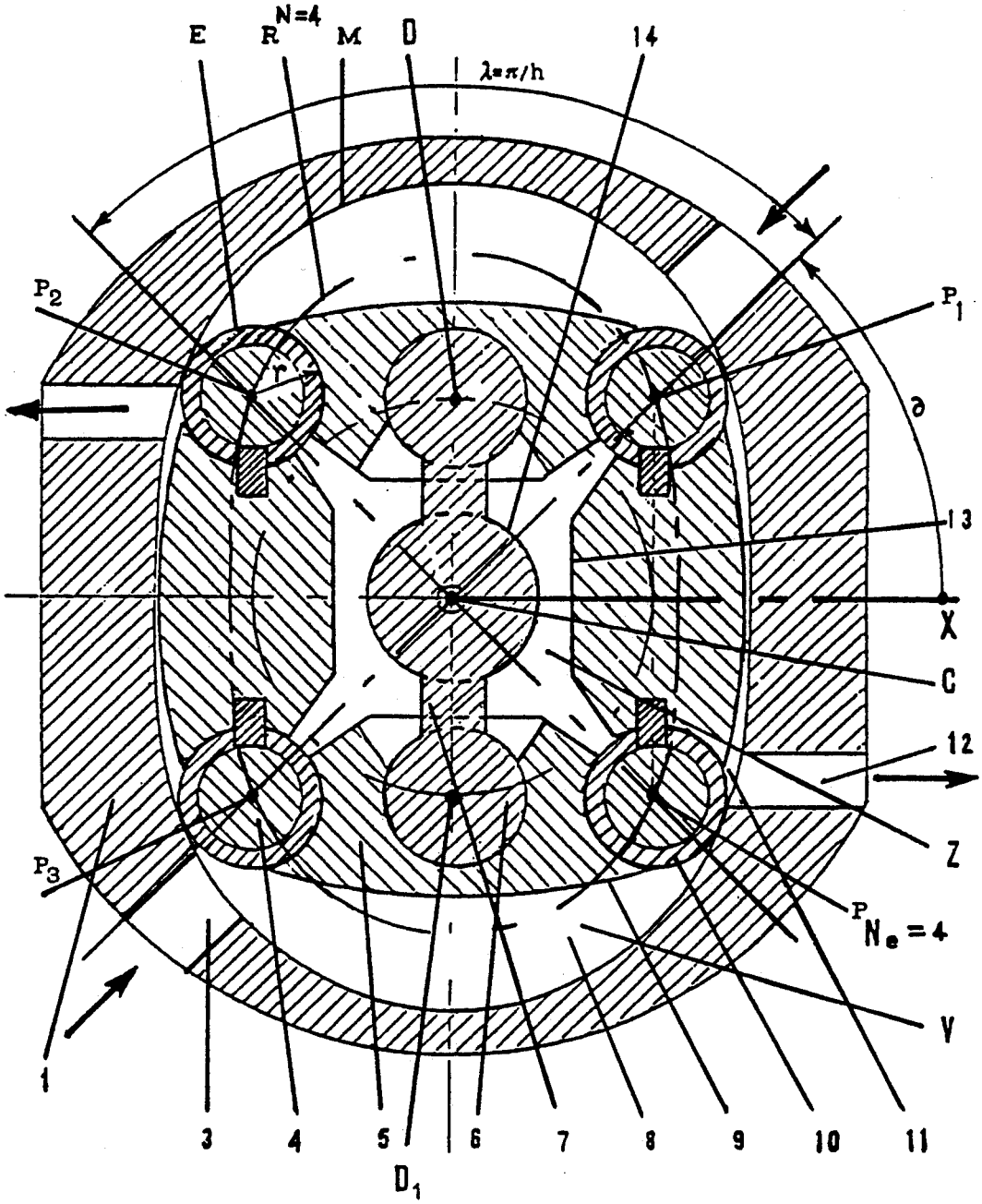
FIG. 3 shows a machine with a four-sided rotor ($N=4$; $N=N_e=N_r$) and an inner stator contour M with two lobes; axes $Y_o$, $Y_c$ coincide.

Referring to FIGS. 1, 2 and 3, a compressor-pump of the cyclic volume machine type will now be described.

Stator body 1 has an inner cavity with perimetral surface M.

Transmission shaft 14 has axis $Y_c$ which intersects plane F orthogonally at point C.

Rotor points $P_i$ ($i=1$ to $N_e$) run on a trajectory $R^N$ which has the property of constant length $\overline{W}, \overline{W}=\overline{P_iP_{i+1}}$; each rotor side is composed of one oscillating piston 5 between two hinges.

The rotor touches contour M by interposed rings 10 of radius r.

Cylinders 4 and rings 10 have a common axis $Y_i$. In FIG. 3 a non-extensible connection (bar 7) joins pivots 6 centered in points D, $D_1$ with transmission shaft 14. In FIG. 1, half point O of segment $DD_1$ does not coincide with pole C.

Rotor sides or pistons 5 have equal height; their flat bases are parallel to plane Γ and slip over the stator bases.

External surface 9 of each piston 5 corresponds to one rotating chamber V.

Chambers V retain variable volumes $V_{(\partial)}$ which vary from a maximum to a minimum turning through a fixed number of stator chambers 8. Integer number N is the modulus of curve $R^N$.

Fluid(s) enter chamber(s) V through valve 3 and is/are discharged, compressed, through valve 12.

Each chamber V is defined by piston wall 9, two surfaces E of rings 10, cylinder M, and two stator bases.

Surfaces 13 of $N_r$ pistons 5 form one chamber Z of variable volume $Z_{(\partial)}$ inside the rotor.

Chamber Z is defined by $N_e$ surfaces 13 of pistons 5,$N_e$ surfaces E of rings 10 and the two stator bases; it pumps a fluid which enters and exits through holding valves (not shown in the figures).

Volumes $V_{(\partial)}$ are defined in any position of the rotor.

The fluid in chamber Z cools and lubricates the machine and may feed a hydraulic accumulator (not shown in figures).

Chambers V and Z may be interconnected.

Figure 6:
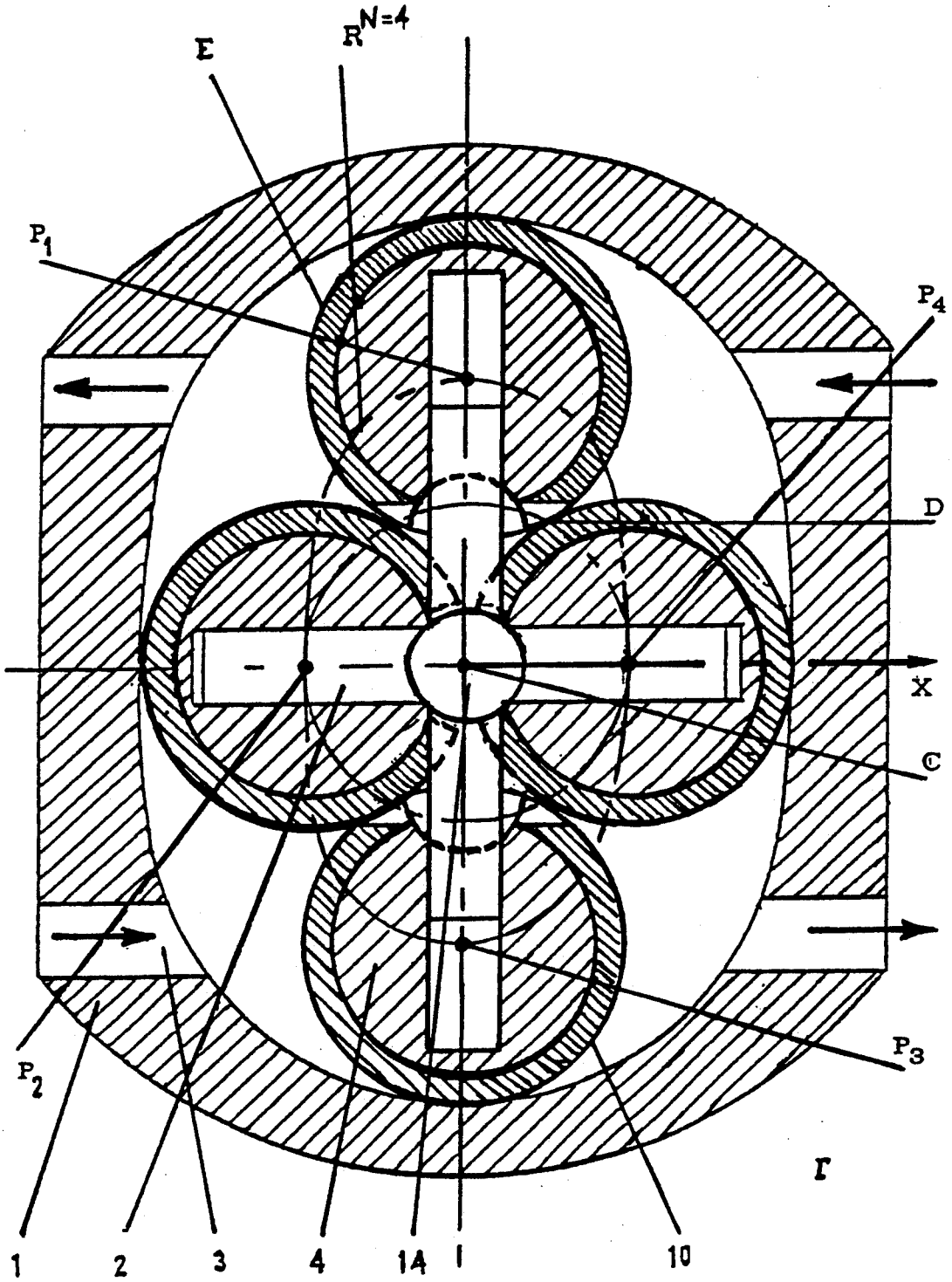
FIG. 6 shows a machine with a rotor composed of cylinders only.

The rotor can be made by packing thin metal sheets together. It may also be an open prismatic structure, and composed of only one side without hinges (FIG. 7), or of only solid cylinders (FIG. 6).

None of the machines shown in any of the figures are restrictive cases of the present invention.

Figure 4:
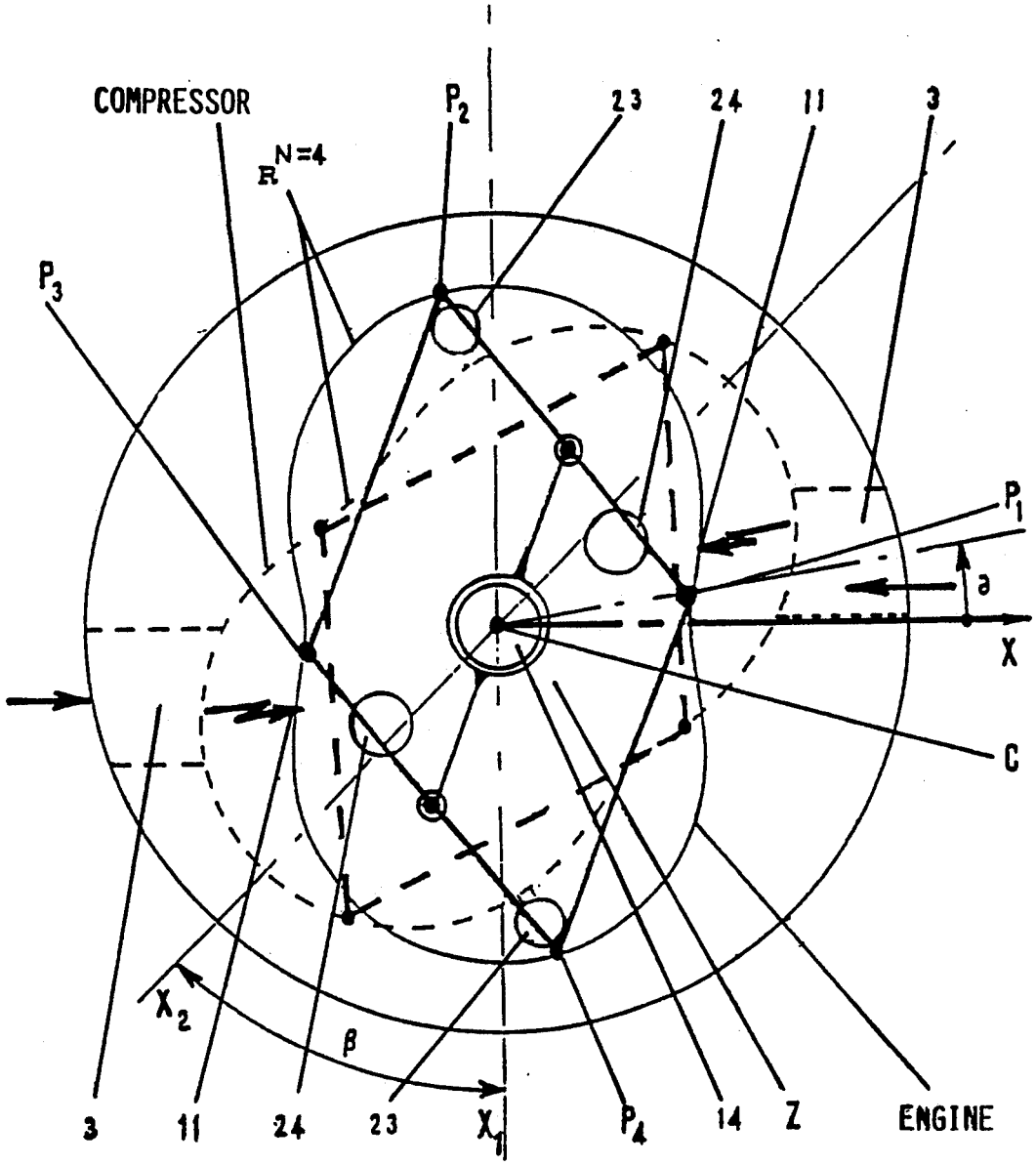
FIG. 4 is a schematic drawing of a two-stroke engine composed of two machines of the type shown in FIG. 3.

FIG. 4 shows a schematic view of a coaxial cyclic volume machine composed of one rotating cyclic volume machine as a compressor, and one cyclic volume machine as an engine, with one common transmission shaft 14 and one common stator base between them. Operating fluid enters 3, flows through the two transfer channels 23 bored in the common base, and is controlled by engine rotor $P_1P_2P_3P_4$.

The fluid enters the two opposite combustion chambers, where it is further compressed for combustion. Waste gases are discharged through channels 24 bored in the stator base of the engine side.

Maximum fluid compression occurs in engine area where ignition takes place and expansion of gases rotates the polygonal structure of the engine and the compressor. In this example, it is assumed that cooling fluid enters chamber Z of the compressor, passing through the Z area of the engine, and powers a hydraulic accumulator which is also a heat radiator (not shown).

Major axes $X_1$ and $X_2$, of engine and compressor contours M form angle $\beta$ or planeΓ. Angle $\beta$ is important for precompression of the engine when axis of channel 23 is parallel to axis $Y_c$.

With appropriate configuration of the discharge channels, the thrust of waste gases may be exploited to produce a jet action.

Referring to FIGS. 1-7, points $P_i$, . . . i=1 to N, $N=M_e$, run along a plane rotoid curve $R^N$, which has modulus $N \geqq 2$; N is a number integer. Points $P_i$ maintain constant reciprocal distance $\overline{W}$. Rotoid curve $R^N$ is the trajectory of the N vertices of the family of equilateral polygons $P_i \ldots P_N$ of side length $\overline{W}=\overline{P_iP_{i+1}}$.

Modulus N conditions the choice of the maximum number $N_r$ of rotor sides $1<N_r<N$ which have number $N_e$ of equal cylindrical ends E; $2<Ne<2(Nr-1)$.

In the most general case, these rotoid curves are defined by the mathematical law Equation (1), the published for the first time in the booklet: "Class of algebraic curves passing through cyclic points. Invariance of length. Invariance of area. ROTOIDS" on page 15, line 17, published privately by Italo Contiero and Luigi Beghi in Padova on Mar. 16, 1985. This booklet has regularly been open to public inspection according to Italian law.

All curves belonging to this class are obtained by transforming one assigned plane curve L as follows. All the following reasoning expound geometric implications and the mathematical significance of symbols of Equation 1.

Figure 5:
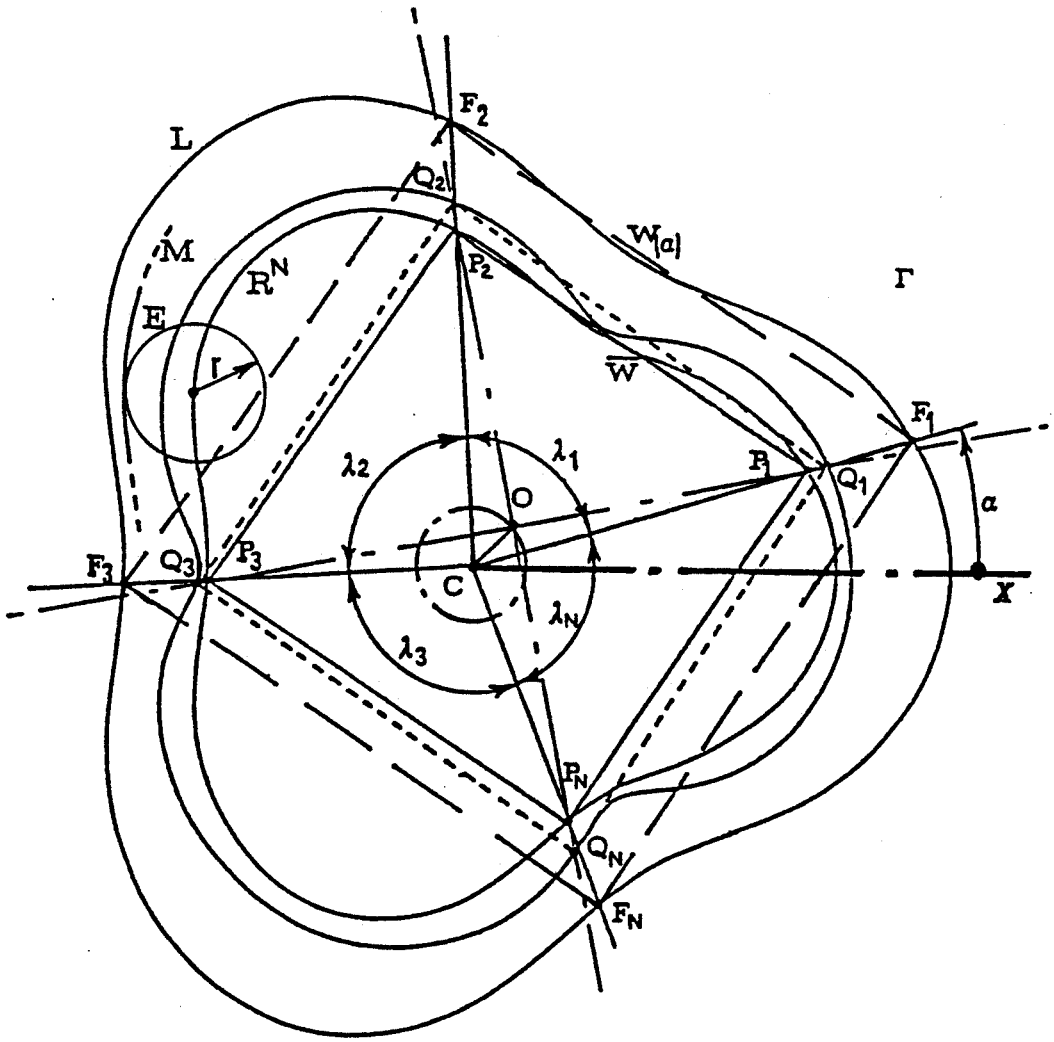
FIG. 5 shows rotoid curves $R^N$ with the property of invariant length $\overline{W}$.

Referring to FIG. 5, let L be a simple, closed, curve on reference plane Γ.

Let points Fi, i+1 to $N_1$ lie on a curve L and be distributed in infinite groups of points, each group consisting of N points $F_1, \ldots F_N$, $N \geqq 2$. Points $F_i$ are vertices of one equilateral N-polygon $F_i$ with side length $\overline{F_iF_{i+1}}=W_{(\alpha)}$; which depends on angular abscissa $\alpha=F_1\hat{C}X$ $O \leqq \alpha \leqq 2\pi$.

Shaft axis $Y_c$ is orthogonal to plane Γ in a point C inside the region defined by curve L. In general point C is distinct from centroid O of N-polygon $F_i$.

Referring to a polar system of coordinates with pole C and polar axis X on reference plane Γ, let curve L be defined by polar equation $\overline{CF_1}=F_{(\alpha)}$.

$F_{(\alpha)}>O$, $f_{(\alpha)}=f_{(\alpha+2\pi)}$, L being a closed curve, function $f_{(\alpha)}$ will be defined for any value of α; then $f(\alpha)$ is a continuous function.

According to the conventional direction of positive angular abscissae α, for any value of α at least one N-polygon $F_i$ will exist, because L is a closed curve with a continuous $f_{(\alpha)}$.

Let L be formed so that only one equilateral N-polygon $F_i$ corresponds to each value of α; therefore, only one side length $W_{(\alpha)}$ corresponds to any α.

Let $F_i\hat{C}F_{i+1}=\pi_i$ be measures of positive angles and $\pi_1\pi_2+\ldots+\pi_N=2\pi$.

A system of N equalities expressed by polar radius f of curve L and $\pi_1, \pi_2, \ldots, \pi_N$ is valid according to the consine rule (Carnot's theorem), to determine side length: $\overline{F_iF_{i+1}}=W_{(\alpha)}$.

Radius f is then transformed into polar radius g of a curve, which will be a rotoid curve $R^N$ according to the law:

$$g_{(\partial)}=\overline{W}\cdot f_{(\alpha)}/W_{(\alpha)} \quad (1)$$

in which $\overline{W}$ is an assigned constant; and as $f_{(\alpha)}$ is a continuous function, $g_{(\partial)}=\overline{CP_1}$ will also be a continuous function, $\partial=P_1\hat{C}X$ is the angular abscissa of radius g. The point $O_1$ is a rotor vertice of polar coordinates $\overline{CP_1}=g$, $P_1\hat{C}X=\partial$, on a rotoid curve $R^N$. Radius $g_{(\partial)}$ is excluded from defining a circle, $g_{(\partial)} \neq$ constant, by means of a convenient position of pole C and a suitable value of modulus N.

In the cases of rotoid curves drawn with continuous lines, angular abscissa ∂ depends on modulus N, as shown in the mechanisms of FIGS. 8, 12, 13, and 16.

If we consider on curve $R^N$ one group of N rotor vertices $P_i$ of polar coordinates:

$$g_{\partial,\partial};\ g_{(\partial+\lambda),\partial}+\lambda_i, \ldots ;\ g_{(\partial+\sum_1^N i\lambda i)},\ \partial+\sum_1^N i\lambda i$$

for each value of angular abscissa ∂, it is demonstrated that:

calculations of the measures of the rotor segments $\overline{P_iP_{i+1}}$ according to the cosine rule, give constant value $\overline{W}=\overline{P_iP_1}$;

therefore points $P_i$ are distributed on $R^N$ in infinite groups of N points which are vertices of a family of equilateral N-polygons $O_i$ with side length $\overline{W}$, which is not dependent on angular abscissa α, i.e. curve $R^N$ defined by function $g_{(\partial)}$ is a trajectory of a group of running rotor vertices $O_i$ (i=1 to N) which maintain constant reciprocal distance $\overline{w}$. This is the peculiar feature of all rotoid curves with property of invariant length.

In all cases:

if L is a closed, regular, plane curve, by means of law (1), the transformed curve will also be closed and regular; and if L is an algebraic curve, transformed curve will also be an algebraic curve.

The Kempe theorem demonstrates that algebraic curves may be drawn with continuous lines by means of an appropriate system of bars.

FIG. 1 shows a machine in a general case: rotor axis $Y_o$ is orthogonal to reference plane Γ in centroid O, which is different from pole C, $Y_o//Y_c$. Angles $O_iP_{i+1}$-$P_{i+2}$ vary with angular abscissa o, therefore the rotor $P_i$ is of hinged type.

In the most general case: rotor centroid O is the vertex of angles $P_iOP_{i+1}$ which depend on angular abscissa α.

In particular cases of moduli N=2, N=3, N=4, centroid O with rotor vertices define angles $P_iOP_{i+1}$-$=Q_iQ_{i+1}=2\pi/N$, which do not depend on angular abscissa α (FIGS. 1, 3, 5 and 7).

In these cases, a circle, centered on centroid O with radius $\overline{OQ_1}$,, intercepts N point $Q_i$ on half-lines $OP_i$ of FIG. 5.

Points $Q_i$ are on a rotoid curve because measures of rotor segments $\overline{Q_iQ_{i+1}}$ are constant, not dependent on angular abscissa α. Rotor angles $Q_iQ_{i+1}Q_{i+2}$ are also constant.

Cyclic volume machines with rotor vertices in points $Q_i$ are characterized by the non-deformability of the rotor and the rotoid curve is defined by radius $\overline{CQ_1}$ and angular abscissa $Q_1\hat{C}X$.

In the particular case of a curve $L^h$ with h symmetry axes, $L^h$ invariant if rotated round pole C of angle $2\lambda/=\pi/h$, and modulus N=2h, pole C with points $F_i$, i=1 to 2h defines constant angles $F_i\hat{C}F_{i+1}=\lambda=\pi/2h$.

The side-length $W_{(\alpha)}$ of N-polygon $F_i$ in equation (1) is:

$$\overline{W}_{(\alpha)}=\sqrt{\overline{CF_i}^2+\overline{CF}_{i+1}^2-2\cdot\overline{CF_i}\cdot\overline{CF}_{i+1}\cdot\cos\lambda}$$

Figure 7:
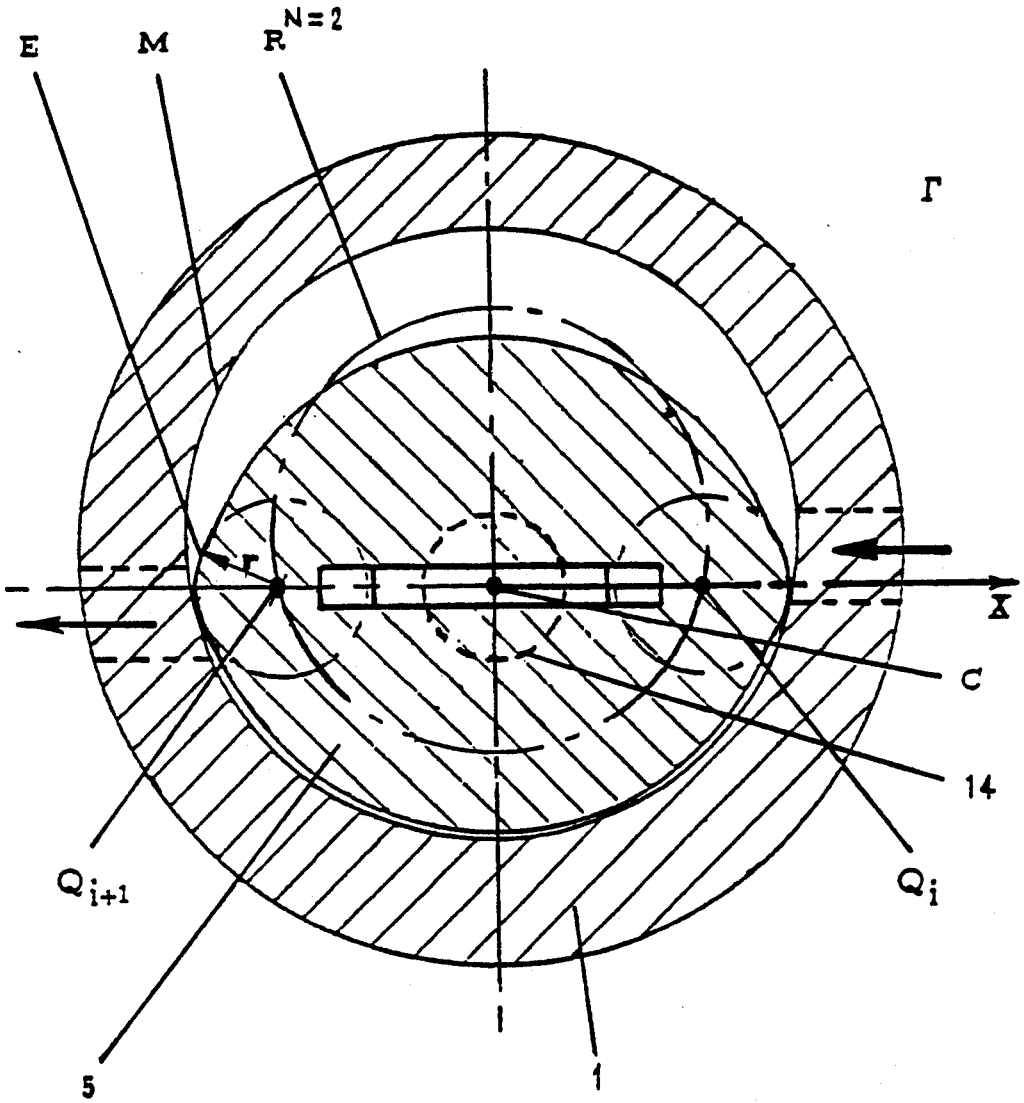
FIG. 7 shows a machine with a rotor of single blade type, the rotor vertices are on a rotoid curve $R^N=2$.

In these cases radius $g_\partial = \overline{CP_1}$ or equation (1), and angular abscissa $\partial = P_1\hat{C}X$ define a rotoid $R^N$ with the property of:

$$\overline{w} = \sqrt{\overline{CP_1}^2 + \overline{CP}_{i+1}^2 - 2 \cdot \overline{CP_i} \cdot \overline{CP_{i+1}} \cdot \cos\lambda}$$

points $P_i$ are rotor vertices and, with pole C, define constant angles $P_i\hat{C}P_{i+1} = \lambda = \pi/h$ (FIGS. 2, 3, and 7).

Machines characterized by these trajectories of rotor vertices have rotor axis y coinciding with shaft axis $Y_c$ and with the symmetry axis of stator cavity U.

In the following the equation (1) is applied for transforming a conical curve L defined by polar radius $\overline{CF_1} = f_{(\alpha)}$ into a rotoid curve $R^{N=4}$ defined by polar radius $g_{(\partial)}$: let curve L be an ellipse with symmetry center in pole C; and half-axes $B = f_I$), $A = f_{\pi/2}$, $A > B$,, defined by polar radius:

$$f(\alpha) = A \cdot B / \sqrt{(B^2 \cdot \cos^2\alpha + A^2 \cdot \sin^2\alpha}$$

let $W_1 = \sqrt{A^2 + B^2}$ be constant length.

By equation (b 1), radius vector $f_{(\alpha)}$ is transformed into radius vector $g_{2(\partial)}$.

$$g_{2(\partial)} = W_1 \cdot f_{(\alpha)} / W_{(\alpha)}$$

$$g_{2(\partial)} = \sqrt{A^2 \cdot \sin^2\alpha + B^2 \cdot \cos^2\alpha}$$

Equation $g_2(\partial)$ has the property of invariant length:

$$W_1 = \sqrt{g^2_{2(\partial)} + g^2_{2(\partial+\pi/2)}}$$

Square root $g_{1(\alpha)}$ of algebraical summation of one constant $\alpha^2$ with radius vector $g^2_{2(\alpha)}$ does not change the property of invariant length:

$$g_{1(\partial)} = \sqrt{a^2 - g^2_{2(\partial)}}$$

$$g_{1(\partial)} = \sqrt{a^2 - A^2 + (A^2 - B^2)\cos^2\alpha}$$

Equation $g_{1(\partial)}$ also has the property of invariant length:

$$\overline{W} = \sqrt{g^2_{11(\partial)} + g^2_{11(\partial+\pi/2)}}$$

Multiplicative integer $m = h/2$ of angular abscissa $\alpha$ is introduced in equation $g_{1(\partial)}$ to define a new curve $R^N$ with h symmetry axes, $h \geqq 2$ $$g_{(\phi)} = A \cdot \sqrt{(p-1) + (1-q) \cdot \cos^2(m\partial)} \quad (2)$$

where $p = a^2/A^2$ and $q = B^2/A^2$.

When m is an odd integer number ($h = 2,6,10,14 \ldots$), equation $g_{(\partial)} = \overline{CP_1}$ of formula (2) has the property of invariant length $\overline{W} = \sqrt{g^2_{(\psi)} + g^2_{(\psi+\pi/2)}}$ Polar radius of equation (2), and angular abscissa $\psi = m\partial$ define rotoid curves $R^{N=4}$ with h symmetry axes on which the four rotor vertices $P_i$ run.

A particular case of equation (2) occurs when $h = 2$, $N = 4$, and $(p-1) = (1-q) = 1$ (i.e., $p = 2$; $q = 0$), equation $g_{(\psi)}\psi = 2$ defines rotoid curve $R^{N=4}$ of a machine as shown in FIG. 3, in which the four points $O_i$ are vertices of a family of rhombuses $O_i$ with centroid in pole C; in this case rotoid curve $R^{N=4}$ is defined by:

$$g_{(\partial)} = \overline{CP_1} = A\sqrt{1 + \cos^2\alpha}$$

$$\overline{P_1P_{i+1}} + A\sqrt{3}$$

$$\partial = \alpha + \pi/2$$

In FIG. 3, $D, D_1$ are half-points of rotor sides $P_1P_2$, $P_3P_4$; radius $\overline{CF} = \overline{W}/2$ defines a circumference center in pole C.

An inextensible connection (bar 7) joins points $D, D_1$ to center C of transmission shaft 14.

In the case of other hypotheses, points D need not be on a circumference.

In the case of rotor axis $Y_o$ coincident with stator axis $Y_c$, FIGS. 2, 3, the working of the cyclic volume machine does not change if stator 1 rotates and piston centers D, $D_1$ are fixed to one flange.

In this case the stator also works as a balanced flywheel.

Referring to FIG. 2, in which $N = 6$, the six rotor vertices $P_i$ are points of a rotoid curve $R^{N=2h}$ with $h = 3$ symmetry axes $\lambda = \pi/3$. In this case, formula (2) may be employed to define a curve $L^h$.

Transformation $[L^{h=3}] \rightarrow [R^{N=6}]$ takes place by law (1), wherein:

$$f_{(\alpha)} = A\sqrt{(p-1) + (1-q)\cos^2(h\alpha/2)}$$

$$W_{(\alpha)} = \sqrt{f^2_{(\alpha)} + f_{(\alpha+\lambda)} - 2f_{(\alpha)}f_{(\alpha+\lambda)}\cos\lambda}$$

The rotoid curve $R^{N=6}$ is defined by $g_{(\partial)}$ of equation (1) wherein $\partial = \alpha$.

FIG. 6 shows a machine with a rotor composed of cylinders only wherein a cross-bar 2 slides on cylinders (disks) points D belong to contact lines between consecutive cylindrical surfaces E of rings 10: cylinders E have circular bases of radius $r = \overline{P_iP_{i+1}} = \overline{W}/2$.

By suitable segments on the ends of rotor vertices and using abrasive fluids, the rotor of the cyclic volume machine may be used as a tool to rectify perimetral surface M of inner stator cavity U. This may be radiused with stator bases according to complementary profile to the profile of rotor surface E.

APPARATUS ACCORDING TO THE INVENTION FOR TRANSFORMING A CIRCUMFERENCE AND TO DESIGN:

I. Rotoids $R^{N=4}$, for the cyclic volume machine of FIG. 3;

II. Rotoid $R^{N=2}$, for the cyclic volume machine of FIG. 7; and

III. Ellipse of axes u, b.

I

Figure 8:
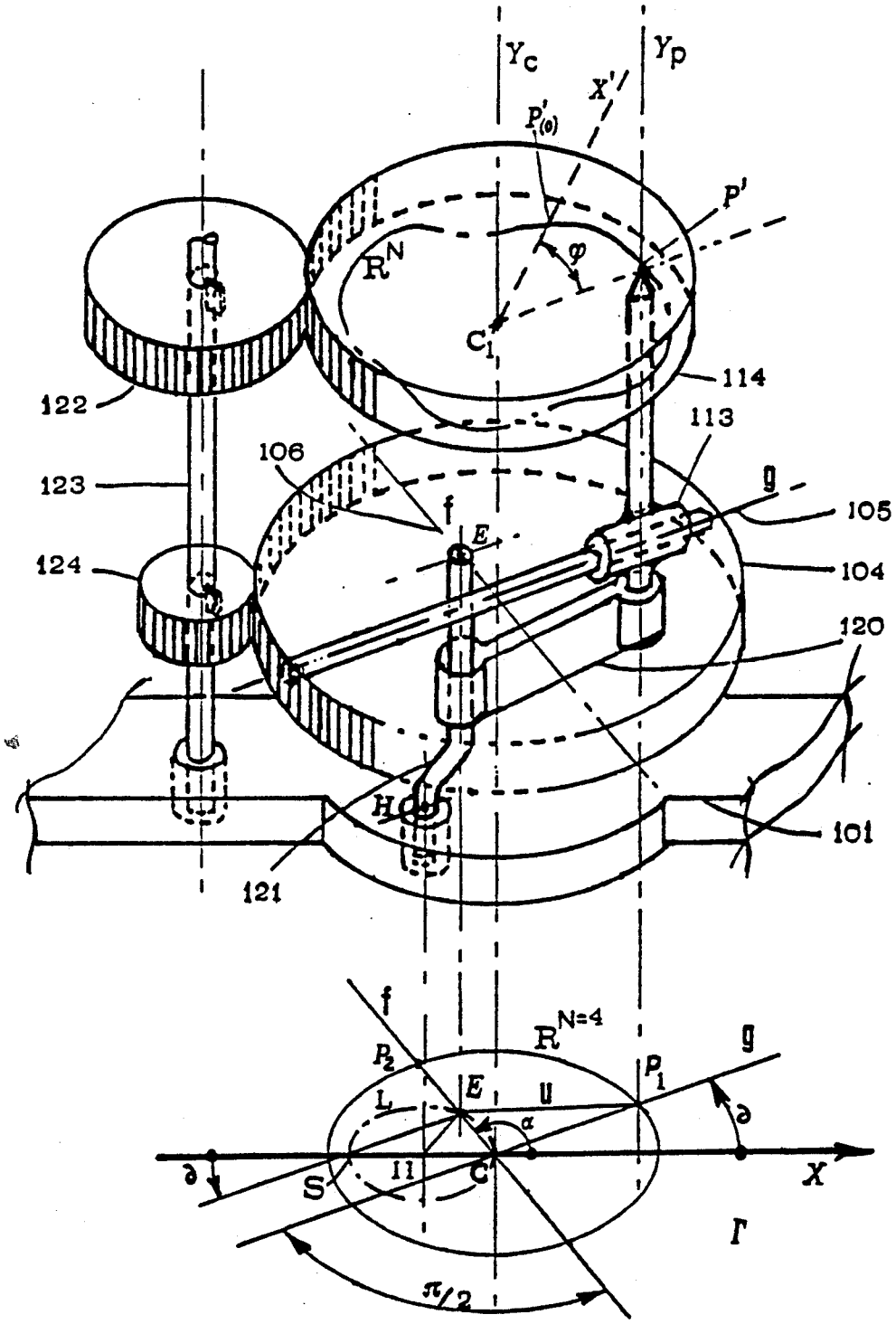
FIG. 8 shows an axionometric view of an apparatus according to the invention wherein a first mechanism transforms a circumference L into a rotoid curve with $R^N=4$ with $h=2,6,10\ldots$ symmetry axes.

The axionometric view of FIG. 8 is an embodiment of apparatus according to the invention wherein the mechanisms of FIGS. 10–14 may also be placed.

Runners 105, 106 of axes g,f are placed on a first rotating table 104 of axis $Y_c$, $g\hat{C}X=\partial$.

A slide 113, hinged to a bar 120, moves along runner 105.

Bar 120 has extremities E, $P_i$ on axes f,g respectively, $\overline{EP_1}=u$.

A crank 121 of extremities E, H is hinged to bar 120 and in frame 102, $\overline{EH}=c/2$. Extremity E is hinged on a slide of axis f (not shown in FIG. 8) and moves n circumference L.

A marker, of axis $Y_p$ orthogonal to axis g at point $P_1$, is fixed to slide 113.

The market works on a drawing plane of a second rotating table 114 parallel to both table 104 and reference plane Γ.

Table 114 may rotate round axis $Y_c$ which intercepts drawing plane at point $C_1$, $Y_c//Y_p$ Cogwheels 122, 124, engaged with rotating tables 104, 114, and fixed to shaft 123 supported by frame 101. Referring to axis X' and start point $P_{(o)}$, to one revolution of table 116, m=h/2 revolutions of table 106 correspond; axis X' is on drawing plane.

On the drawing plane marker point O' of polar radius $\overline{CP_1}=\overline{Y_cY_p}=\overline{C_1P}$, has angular abscissa $P'\hat{C}_1X'=\psi$. Axis Z' has origin in point $C_1$ and corresponds to angular abscissa $\Psi=0$ of marker point O'.

A greater ratio $t=m/(m+1)$, is pre-arranged between the first rotating table 104 and the second rotating table 114. Extremity E of crank 121 has angular abscissa $E\hat{H}C=2\partial$; H is center of circumference L on axis X, $\overline{CS}=c$.

Radius $\overline{CP_1}=g_{(\partial)}=\sqrt{u^2-c^2\sin^2\partial}$ defines a rotoid curve with h=2 symmerty axes on reference plane Γ.

Radius $\overline{Y_cY_p}=\overline{C_1P}=g_{(\psi)}=\sqrt{u^2-c^2\sin^2(m\partial)}$ and angular abscissa $\psi=t\partial-m\partial$ defines a curve $R^N$ with h symmetry axes on drawing plane. In the case of m odd number, the curve $R^N$ is a rotoid curve with N-6 because equation $g_{(\psi)}$ has property of invariant length $\overline{W}^2=g^2_{(\psi)}+g^2_{(\psi+\pi/2)}$.

Equation $g_{(\psi)}$ corresponds to equation (2) wherein: $A^2(o-1)=u^2\ A^2(1-q)=-c^2\ h\alpha/2=m\partial$.

Polar equation $\overline{CP_1}$ transformed in cartesian coordinates becomes equation $(x^2+y^2)^2-u^2(x^2+y^2=O$.

Between half axes A, B of a rotoid curve $R^{N=6}$ defined by equation $g_{(\partial)}$ of a transformed ellipse and measures of mechanism of FIG. 8, is following relationship: $A=u$, $B=\sqrt{u^2-c^2}$, $g_{(o)}=A$ and $g_{(\pi/2)}=B$.

On plane Γ, considered two points $S_1,S_2$, with constant radius vector $\overline{CS}=\overline{CS_1}=d$ and angular abscissae $\partial+\gamma$, $\partial+\gamma+\pi$ respectively wherein $\gamma=S_1\hat{C}P_1$;

Between points $S_1$, $S_2$ and points $P_1$, $P_2$ on rotoid $R^{N=4}$ the following relationship exists:

$$\overline{P_1S}^2+\overline{P_1S}^2_1+\overline{P_2S}^2+\overline{P_2S}^2_1=4d+2\overline{W}^2$$

In the case of d=c, on axis X both ellipse and rotoid $R^{N=4}$ have coincident foci $S_1,S_2$.

II

Figure 9:
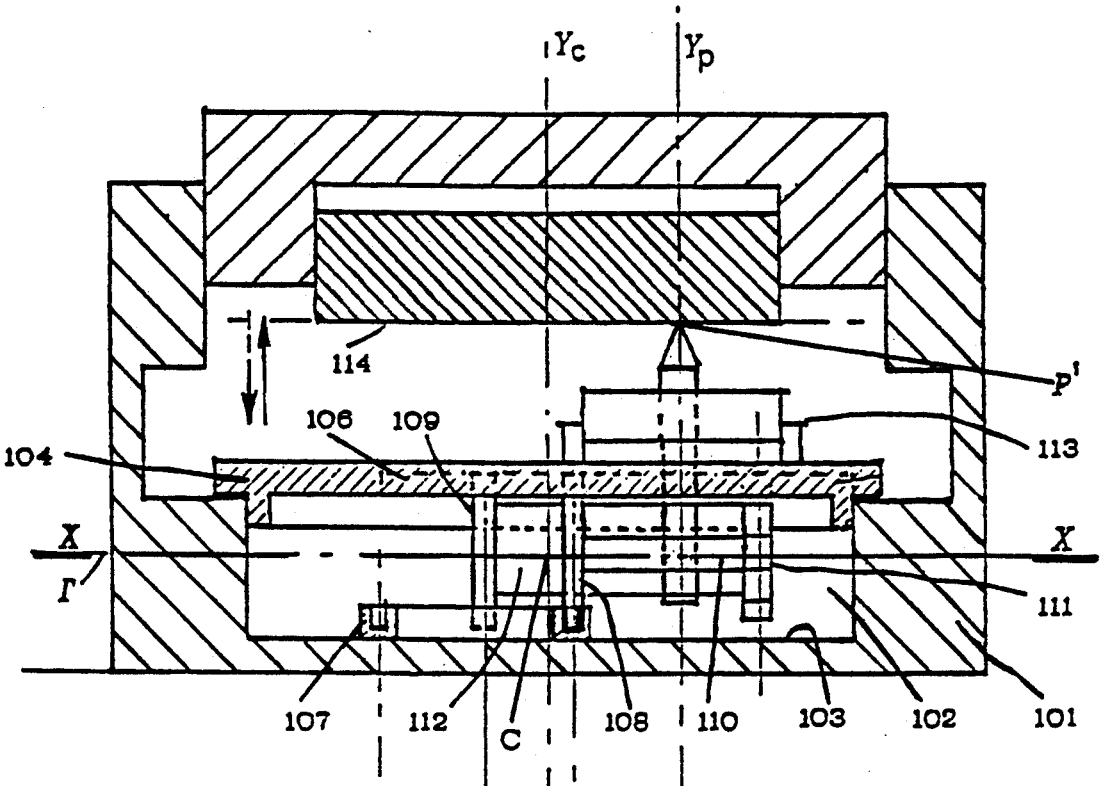
FIG. 9 shows a vertical section, taken along line IX—IX of FIG. 10, of the apparatus of FIG. 8 wherein a mechanism transforms a generic assigned curve L into a rotoid curve $R^N=2$.
Figure 10:
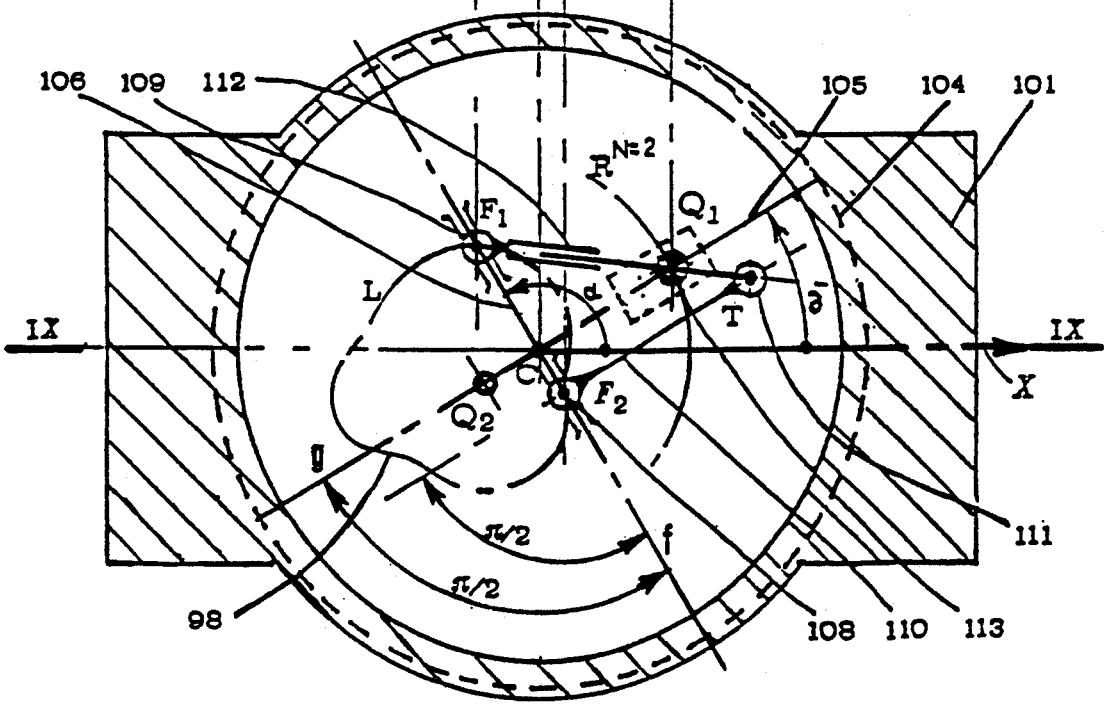
FIG. 10 shows a schematic view of the horizontal section X—X of FIG. 9.

FIGS. 9, 10 show frame 101 with a cylindrical cavity 102 of axis $Y_c$, and a plane base 103. Base 103 is orthogonal to $Y_c$. Rotating table 104 is supported on the edge of cavity 102 and rotates round axis $y_c$ orthogonal to plane Γ at point C. On plane Γ is the usual polar system of reference with pole C and polar axis The section plane X—X of FIG. 9 is reference plane Γ in which polar axis X is the trace of section plane IX—IX of FIG. 10.

To simplify the drawing of FIGS. 9–15, the rotating means of tables 104, 114, as shown in FIG. 8, are omitted, and plane Γ is also considered projection plane of mechanisms.

Referring to FIGS. 9, 10 on the upper surface of table 104 is a slide 113 in runner 105 with axis g.

On the lower surface of table 104 is other two slides in runner 106 with axis f, f//Γ, which intercepts axis g orthogonally in pole C.

A plane runner 107 is parallel to plane F and has a generic curvilinear axis L corresponding to simple close curve L defined by polar radius $\overline{CF}$hd $1=f_{(\alpha)}$. Curve L may be made by several interpolated points; runner 107 is fixed on base 103 of cylindrical cavity 102 and has axis L.

Two pins 108, 109 run with their lower ends along runner 107, while their upper ends run along runner 106.

Pin 108 is held in a slide running along axis f; a bar 110 of length $\overline{W}=\overline{F_2T}$ is fixed to this slide, orthogonally to axis f at a point $F_2$ of curve L $\overline{F_1F_2}=W_{(\alpha)}$.

The other end T of bar 110 is hinged, by means of hinge 111, to a telescopic bar 112, to which pin 109 is in turn hinged. A marker 113 of axis $Y_P$ is lodged in slide 113 and moves along both bar 112 and runner 105. Axis $Y_p$ intersects a drawing plane at point P', $Y_p//Y_c$. The drawing plane may be of a mechanical piece fixed to table 114. Point O' may be either of a marker for drawing a curve or of a milling tool for shaping a stator cavity of a cyclic volume machine.

Referring to FIGS. 9, 10 it is demonstrated that when table 104 rotates the marker, point P' draws a rotoid $R^{N=2}$ defined by equation (1) on drawing plane fixed to the frame 101.

Point T is the center of hinge 111 between bars 110 and 112.

Marker axis $Y_p$ intersect plane Γ at point $Q_1$.

Market point P' on the drawing plane and point $Q_1$ on reference plane Γ draw curves defined by radius $\overline{YcYo}=\overline{CQ_1}$, which has angular abscissa $Q_1\hat{C}X=\partial$.

Triangles $F_1CQ_1$ and $F_1F_2T$ are similar, thus the following relationship exists:

$$\overline{CQ_1}/\overline{CF_1}=\overline{F_2T}/\overline{F_1F_2}$$

$$\overline{CQ_1}=\overline{F_2T}\ \ \overline{CF_1}/\overline{F_1F_2}$$

Market point P' on the drawing plane draws a rotoid curve $R^{N=2}$ defined by angular abscissa $\partial=Q_1\hat{C}X$, and polar radius:

$$\overline{CQ_1}=CP'=g_{(\partial)}=\overline{W}\cdot f_{(\alpha)}f/W_{(\alpha)}$$

This equation corresponds to law (1).

Radii $\overline{CQ_1}$, $\overline{CQ_2}$ of angular abscissae $\partial,\partial+\pi$ respectively, define the position of vertices of rotor of single-blade type as shown in FIG. 7.

Figure 11:
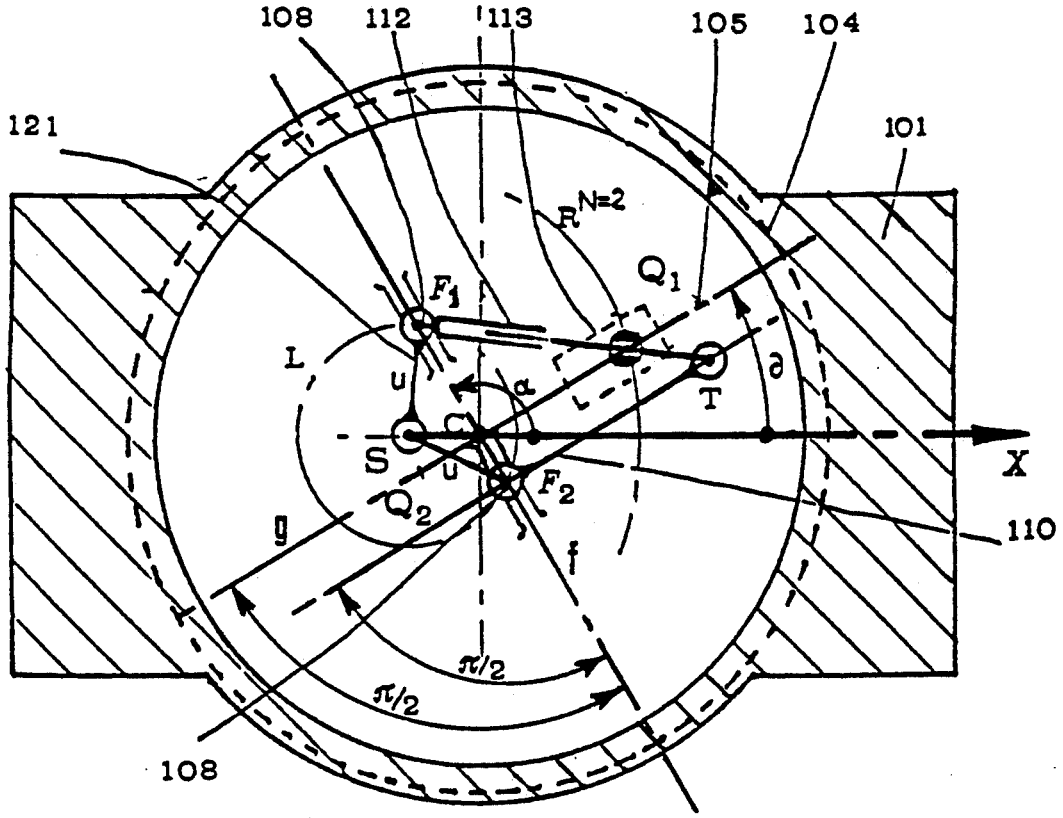
FIG. 11 shows a view like that of FIG. 10, wherein L is a circumference.

FIG. 11 shows an embodiment of FIG. 10 in the case of curve L=circumference of radius u centered in a point S of axis X, $\overline{CS}=c$.

Two equal cranks 121, of length $\overline{SF_1}=\overline{SF_2}=u$, are hinged on frame base 101 at point S of axis X, $u\geqq c$.

The cranks maintain pin centers $F_1,F_2$ of hinges 109, 108 on circumference L.

Rotoid $R^{N=2}$ is designed on the drawing plane by polar radius $\overline{Y_cY_p}=\overline{CQ_1}=g_{(\partial)}$, equation (1), wherein $\partial=Q_1CX$; $F_{(\alpha)}=\sqrt{u^2-C^2\cdot\cos^2}+\partial+c\cdot\sin\partial$; $W_{(\alpha)}=-2\sqrt{u^2-C^2\cdot\cos\partial}$ and $\alpha=F_1\hat{C}X=\partial+\pi/2$.

$$g_{(\partial)} = (\overline{W}/2)\cdot(1 - C\cdot\sin\partial/\sqrt{u^2 - c^2\cdot\cos^2\partial})$$

Figure 12:
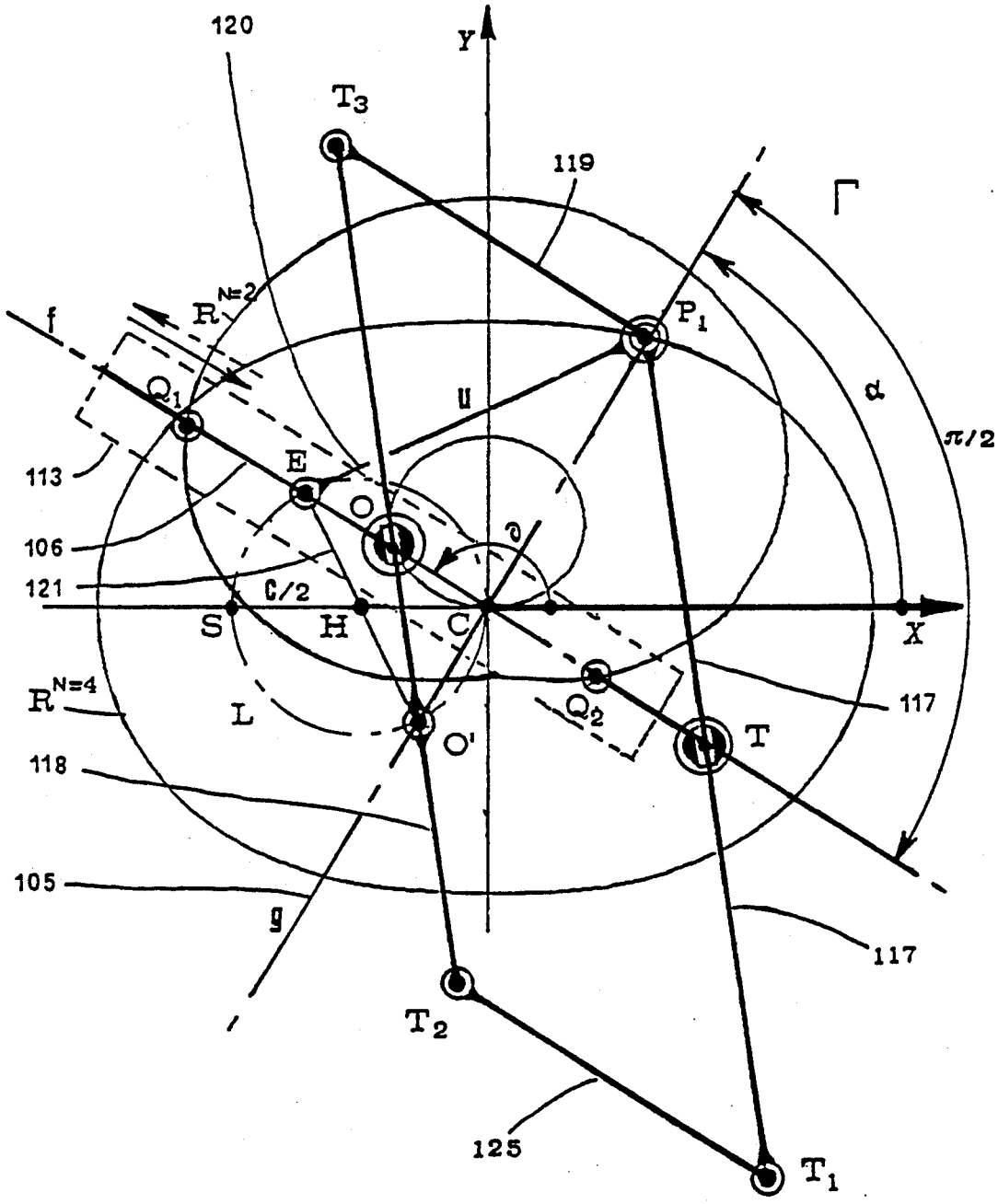
FIG. 12 shows a mechanism with hinged parallelogram for transforming a circumference L into a rotoid curve $R^N=2$ referring to apparatus of FIG. 8.

FIG. 12 shows an embodiment of FIG. 8 on which $P_1$ is the vertex of a parallelogram $P_1T_1T_2T_3$; $P_1$ is also center of a triple hinge.

The parallelogram is composed of hinged bars 117, 118, 119 and 125.

Bar 121, with ends E, O', rotates round its middle point H of angle $E\hat{H}C=2\alpha$. It is hinged to parallelogram side $T_2T_3$ at point O'.

A pin of center O is on slide 113 and moves along both parallelogram side $T_2T_3$ and axis f.

Slide 113 is on runner 106 rotating table 104.

On runner 106 is fixed a pin with center T, $\overline{CT}=K$, which moves along parallelogram side $P_1T_1$.

Two markers on axes $Y_p$, $Y_t$ are orthogonal to axis f of slide 113 at points $Q_1$, $Q_2$ of coordinates $\overline{CQ_1}$, $\alpha+\pi/2$ and $\overline{CQ_2}$, $\alpha+3\pi/2$ respectively, $\overline{OQ_1}=\overline{OQ_2}=\overline{W}/2/$ On the drawing plane each of two markers draws one half of rotoid curve $R^{N=2}\,\overline{YcYp}=\overline{CQ_1}$, $O\leqq 60\leqq\pi$, and $\overline{YcYt}=\overline{CQ_2}$, $\pi\leqq\alpha\leqq 2\pi$.

It is demonstrated that triangles OCO' and $P_1CT$ are similar thus the following relationship exists:

$$\overline{CO}/\overline{CT}=\overline{CO'}/\overline{CP_1}\quad \overline{CO}=\overline{CT}\cdot\overline{CO'}/\overline{CP_1}$$
$$\overline{CQ_1}=\overline{CO}+\overline{OQ_1}$$

radius vector of rotoid $R^{N=2}$ results by substitution:

$$\overline{CQ_1} = W/2 - K\cdot c\cdot\cos\alpha/\sqrt{u^2 - c^2\cdot\sin^2\alpha} \qquad (3)$$

$\partial=Q_1\hat{C}X=\alpha=\pi/2$.

In any rotoid curve $R^{N=2}$, summation $\overline{CQ_1}+\overline{CQ_2}=\overline{W}$ verifies the constant length of the single-blade rotor as for example in a cyclic volume machine with stator cavity defined by a rotoid curve $R^{N=2}$.

Bar 121 may be disengaged from bar 120, and point $O_1$ to be on any close curve; also in this case radius $\overline{CQ_1}$ defines a rotoid curve $R^{R=2}$.

III

Figure 13:
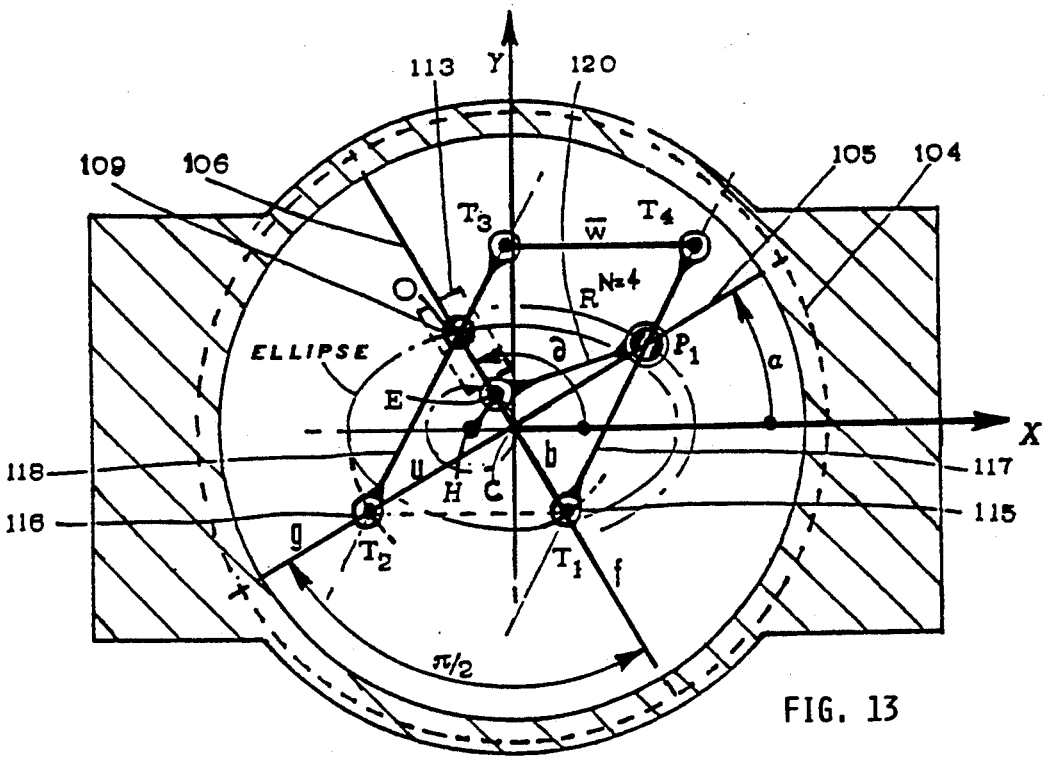
FIG. 13 shows a particular case of mechanism of FIG. for drawing a curve L=ellipse from a rotoid $R^N=4$ and vice versa.

FIG. 13 shows an embodiment of FIG. 12 in the case of:

hinge center O' on table 104 coincides with parallelogram vertice $T_2$ which is the center of hinge 116; bar 121 is disengaged from parallelogram bar 118, $\overline{CT_2}=u$ or b, center T on table 104 coincides with parallelogram vertice $T_1$, $\overline{CT_1}=b$ or u, extremity $P_1$ of bar 120 moves along both bar 117 and axis g, a marker with axis $Y_p$ centered in point O draws on the drawing plane a curve defined both by polar radius:

$$\overline{Y_cY_p} = f_{(\alpha)} = \overline{CO} = b\cdot u/\sqrt{u^2 - c^2\cdot\cos^2\alpha}$$

and angular abscissa $O\hat{C}X=\partial\ \partial=\alpha+\pi/2$.

Radius $\overline{CO}$ defines an ellipse of half axes u,b with center in pole C.

Mechanism of FIG. 13 transforms a circumference into a rotoid $R^{N=4}$ and into an ellipse and vice versa.

Figure 14:
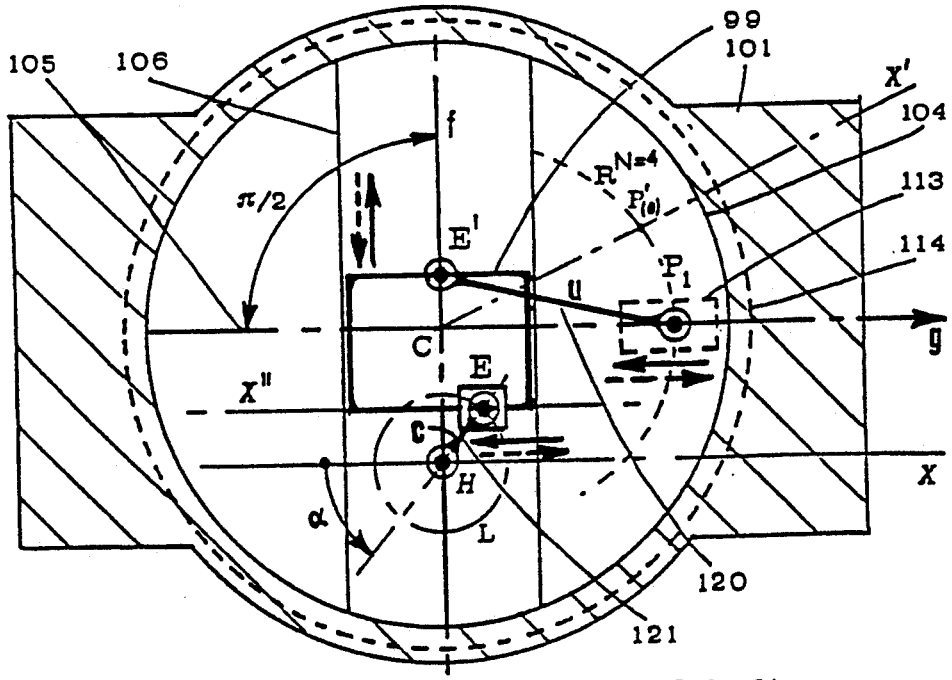
FIG. 14 shows the horizontal section of the apparatus of FIGS. 9 and 10 with a second mechanism for transforming a circumference L into a rotoid curve $R^N=4$ with h symmetry axes.

FIG. 14 shows a mechanism according to the invention for transforming a circumference L into a rotoid curve $R^{N=4}$. The circumference has radius $\overline{HE}=c$ centered on axis f of a runner 106 on the first table 104.

Table 104 is fixed to frame 101.

A rotating crank 121 of length $\overline{EH}=c$ is hinged on base 103 of frame 101 at point H of axis X.

A slide 99 is in first runner 106 and moves along axis f.

A slide with pin of center E moves along axis X'' of a runner in slide 99, X'' || X, $E\hat{H}X=\alpha$, crank 121 moves slide 99 of harmonic motion, $\overline{EX}=c\cdot\sin\alpha$.

An end $P_1$ of a bar 120 of length $\overline{E'P_1}=u$ moves on a second runner 105 along axis g of table 104; other end E' is hinged to slide 99 and moves along axis f of runner 106.

Between crank 121 and the drawing plane on rotating table 114 is a gear ratio m=h/2, which is an odd number.

Marker point P' draws on the drawing plane a rotoid curve $R^{N=4}$ with h symmetry axes defined both by radius vector:

$$Y_cY_p = C_1P_1 = g_{(\phi)} = \sqrt{u^2 - c^2\cdot\sin^2(\alpha/m)}$$

and angular abscissa $P_1C_1X'=\alpha/m=\psi$. For likeness see the FIG. 8 on the table 114 only.

Figure 15:
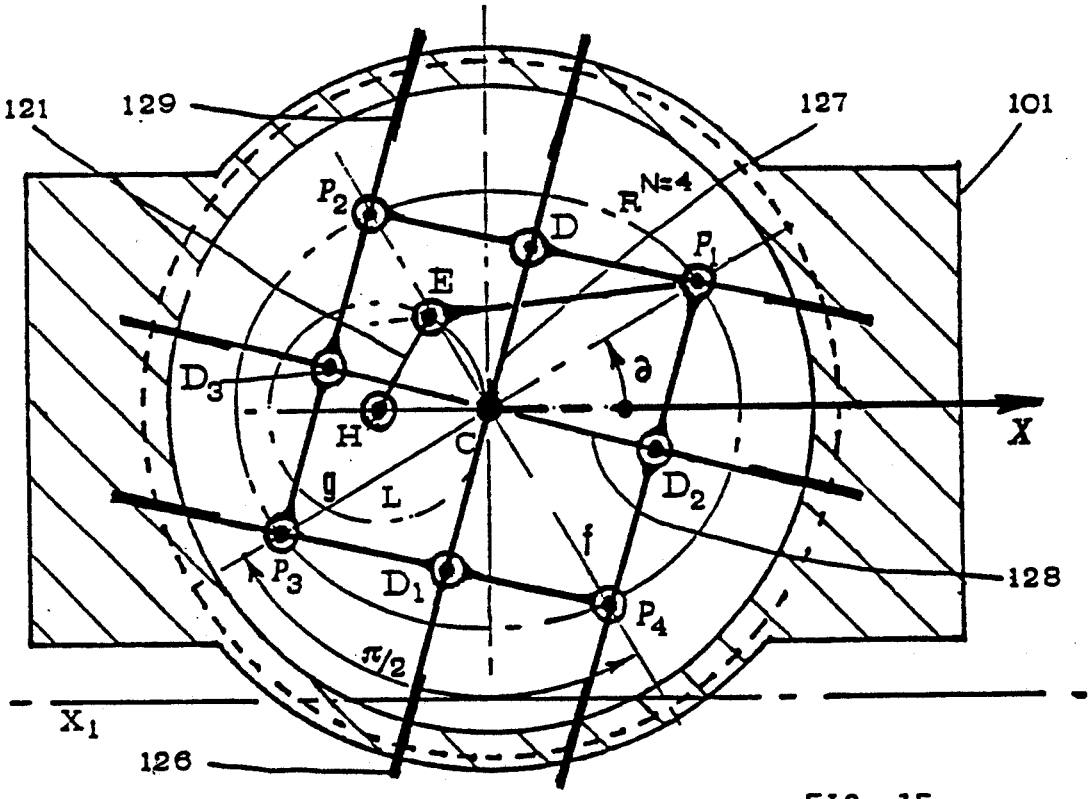
FIG. 15 shows a rotoidal wheel with protruding spokes used as a water mill wheel.

FIG. 15 shows the apparatus of FIG. 8, with a hinged rhombus $P_1P_2P_3P_4$ rotating round center C over table 104: the rhombus has vertices on a rotoid $R^{N=4}$.

A first bar 127 is hinged both to middle points D, $D_1$ of opposite sides of the rhombus, and to center C over first rotating table 104.

A second bar 128 is hinged to the middle point $D_2$, $D_3$ of the other sides of the rhombus.

Bars 127 and 128 have four paddles 126 fixed to protruding spokes.

Also bars of hinged rhombus may have protruding spokes with paddles 129.

Rotating table 104 moves of angle $\partial$ and crank 121 rotates of angle $2\partial$.

The second table 114 and gearing are leaking.

This apparatus may work as a hinged water mill wheel.

Paddles 126, 129 work along water line $X_1$ longer than the circular water mill wheel.

This hinged wheel, called rotoid wheel, therefore improves the transmission of motion energy from water and vice versa.

Figure 16:
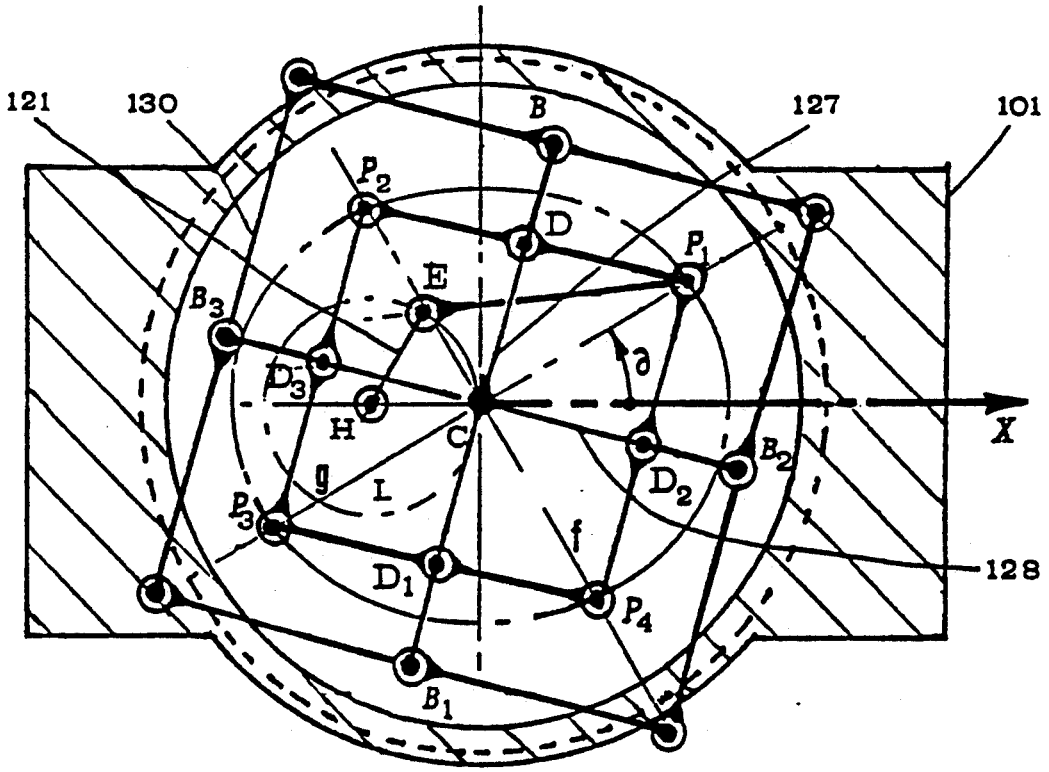
FIG. 16 shows a rotoidal wheel with a hinged parallelogram of eight sides.

FIG. 16 shows a rotoid wheel composed of a hinged wheel as in FIG. 15. Eight equal bars 130 are hinged to the ends $B,B_1B_2,B_3$ of protruding spokes of bars 127, 128; the eight hinged bars form a polygon which is a hinged rotoid wheel with vertices revolving around axis $Y_c$.

I claim:

1. A cyclic volume machine comprising:

one stator with one cylindrical cavity U; p1 one transmission shaft with axis of rotation $Y_c$;

one rotor with axis of rotation $Y_o$ parallel to axis $Y_c$ and with $N_r$ sides which have $N_e$ equal cylindrical surfaces E of radius r at their ends, said stator cavity U having a perimetral surface of contour M which is the external envelope of $N_e$ cylindrical surfaces E of $N_r$ rotor sides, said surfaces E of any rotor side having longitudinal axes $Y_i$, i=1, 2, . . . $N_e$ parallel to axis $Y_c$ and orthogonally intersecting a reference plane Γ in points $P_i, P_{i+1}$ simultaneously guided by the stator cavity and placed at an equal distance $\overline{W}$ for any angular position of the rotor, wherein, referring to a polar system of coordinates with pole C and polar axis X on the plane Γ: each rotor side is a rotating and/or translating piston with points $P_i$ and $P_{i+1}$ running along a rotoid curve $R^N$ which has the property of invariant length $\overline{W}P_iP_{i+1}$, this curve being obtained by transforming a given simple and closed curve L by means of the law $g_{(\partial)}=\overline{W}\cdot F_{(\alpha)}/W_{(\alpha)}$ (1) wherein:

$g_{(\partial)}$ is a non-constant function defining curve $R^N$ in polar coordinates, $g_{(\partial)}=\overline{CP_1}$ being the radius of one rotor vertex $O_1$;

$\partial=P_1CX$ is the angular abscissa of a market point;

$f_{(\alpha)}$ is a given continuous positive function defining curve L, wherein $F_{(\alpha)}=\overline{CF_1}$, $\alpha=F_1CX$, $O\leqq\alpha\leqq 2\pi$;

$\overline{W}$ is the length of segment $P_iP_{i+1}$ of each piston, i=1 to N;

N is an integer to which the modulus of rotoid curve $R^N$ corresponds;

$W_{(\alpha)}$ is the length of the side of an equilateral N-polygon $F_i$, with vertices $F_1F_2 \ldots F_N$ lying on curve L; and wherein:

the rotor is of hinged type;

assigned curve L has h symmetry axes;

N=2h;

angles $F_iCF_{i+1}=O_iCP_{i+1}=\lambda=\pi/2h$ are constant, C being the point in which axis $Y_c$ intersects Γ; and the side length of N-polygon $F_i$ in equation (1) is:

$$W_{(\alpha)}=\sqrt{CF_i^2+CF_{i+1}^2-2\cdot CF_i\cdot CF_{i+1}\cdot\cos\lambda}$$

rotor axis $Y_o$ and axis $Y_c$ of the transmission shaft coincide with the symmetry axis of stator cavity U;

the rotor is composed of N equal cylinders E, and cylinders E have circular bases of radius $$r=P_iP_{i+1}/2=\overline{W}/2$$

2. A machine according to claim 1 wherein: N=4; and $$g_{(\partial)}=A\sqrt{(p-1)+(1-q)\cos^2(h\alpha/2)} \quad (2)$$

wherein h represents the number of symmetry axes of curve $R^N$, and A, p, q are constants, $\partial=2\alpha/h$.

3. A machine according to claim 1, wherein, the rotor comprises N=2h rotor vertices $P_1$, i=1 to 2h;

the assigned curve L is defined by equations $$f_{(\alpha)}=A\cdot\sqrt{(p-1)+(1-q)\cos^2(h\alpha/2)},$$

and

-continued $$W_{(\alpha)}=\sqrt{f_{(\alpha)}^2+f_{(\alpha+\lambda)}^2-2\cdot f_{(\alpha)}\cdot f_{(\alpha+\lambda)}\cdot\cos\lambda}$$

the rotoid curve $R^N$ is defined by $f_{(\partial)}$, where $g_{(\partial)}=\overline{W}\cdot f_{(\alpha)}/W_{(\alpha)}$ and wherein $\partial=\alpha$.

4. A cyclic volume machine comprising:

one stator with one cylindrical cavity U;

one transmission shaft with axis of rotation $Y_c$;

one rotor with axis of rotation $Y_o$ parallel to axis $Y_c$ and with $N_r$ sides which have $N_e$ equal cylindrical surfaces E of radius r at their ends, said stator cavity U having a perimetral surface of contour M which is the external envelope of $N_e$ cylindrical surfaces E of $N_r$ rotor sides, said surfaces E of any rotor side having longitudinal axes $Y_i$, i=1,2, . . . $N_e$ parallel to axis $Y_c$ and orthogonally intersecting a reference plane Γ in points $P_i, P_{i+1}$ at an equal distance $\overline{W}$ for any angular position of the rotor, wherein, referring to a polar system of coordinates with pole C and polar axis X on the plane Γ: each rotor side is a rotating and/or translating piston with points $P_i$ and $P_{i+1}$ running along a rotoid curve $R^N$ which has the property of invariant length $\overline{W}=O_iP_{i+1}$, this curve being obtained by transforming a given simple plane and closed curve L by means of the law $g_{(\partial)}=\overline{W}\cdot f_{(\alpha)}/W_{(\alpha)}$(1) wherein:

$g_{(\partial)}$ is a non-constant function defining curve $R^N$ in polar coordinates, $g_{(\partial)}=\overline{CP_1}$ being the radius of one rotor vertex $P_1$;

$\partial=P_1CX$ is the angular abscissa of a market point;

$f_{(\alpha)}$ is a given continuous positive function defining curve L, wherein $f_{(\alpha)}=\overline{CF_1}$, $\alpha=F_1CX$, $O\leqq\alpha\leqq 2\pi$;

$\overline{W}$ is the length of segment $P_1P_{i+1}$ of each piston, i=1 to N;

N is an integer to which the modulus of rotoid curve $R^N$ corresponds;

$W_{(\alpha)}$ is the length of the side of an equilateral N-polygon $F_i$, with vertices $F_1F_2 \ldots F_N$ lying on curve L; and wherein:

the rotor is of hinged type;

assigned curve L has h symmetry axes;

N=2h angles $F_iCF_{i+1}=O_iCF_{i+1}=\lambda=\pi/2h$ are constant, C being the point in which axis $Y_c$ intersects Γ; and the side length of N-polygon $F_i$ in equation (1) is:

$$W_{(\alpha)}=\sqrt{CF_i^2+CF_{i+1}^2-2CF_i\cdot CF_{i+1}\cdot\cos\lambda}$$

rotor axis $Y_o$ and axis $Y_C$ of the transmission shaft coincide with the symmetry axis of stator cavity U; and the rotor is composed of N equal cylinders E, and cylinders E have circular bases of radius $$r=P_iP_{i+1}/2=\overline{W}/2$$

5. A machine according to claim 4 wherein: N=4; and $$g_{(\partial)}=A\sqrt{(p-1)+(1-q)\cos^2(h\alpha/2)} \quad (2)$$

wherein h represents the number of symmetry axes of curve $R^N$, and A, p, q are constants, $\partial = 2\alpha/h$.

6. A machine according to claim 4, wherein, the rotor comprises $N=2h$ rotor vertices $P_1$, $i=1$ to 2h;

the assigned curve L is defined by equations $$f_{(\alpha)} = A \cdot \sqrt{(p-1) + (1-q)\cos^2(h\alpha/2)},$$

and $$W_{(\alpha)} = \sqrt{f^2_{(\alpha)} + f^2_{(\alpha+\lambda)} - 2 \cdot f_{(\alpha)} \cdot f_{(\alpha+\lambda)} \cdot \cos\lambda},$$

the rotoid curve $R^N$ is defined by $g_{(\partial)}$, where $g_{(\partial)} = \overline{W} \cdot f_{(\alpha)}/W_{(\alpha)}$ and wherein $\partial = \alpha$.

* * * * *